United States Patent [19]

Luke et al.

[11] Patent Number: 4,481,954

[45] Date of Patent: Nov. 13, 1984

[54] CIGARETTES

[75] Inventors: John A. Luke, Eastleigh; Kenneth J. H. MacLean, Southampton, both of England

[73] Assignee: British-American Tobacco Company Limited, London, England

[21] Appl. No.: 402,242

[22] Filed: Jul. 27, 1982

[30] Foreign Application Priority Data

Aug. 3, 1981 [GB] United Kingdom ..... 8123697

[51] Int. Cl.[3] ..... A24D 1/02

[52] U.S. Cl. ..... 131/77; 131/78; 131/80; 131/94; 131/360; 131/365

[58] Field of Search ..... 131/94, 77, 78, 365, 131/80

[56] References Cited

U.S. PATENT DOCUMENTS 4,149,546 4/1979 Luke et al. ..... 131/94

4,364,403 12/1982 Horsewell et al. ..... 131/365

*Primary Examiner*—V. Millin

*Attorney, Agent, or Firm*—Kane, Dalsimer, Kane, Sullivan and Kurucz

[57] ABSTRACT

The invention concerns a method for modifying the peripheral conformation of a cigarette, which has an external, heat deformable, wrapper comprising a proportion of thermoplastic fibers or filaments. The method comprises the application of heat to the wrapper. Heat is applied by a heat forming means moved relatively and in contact with the cigarette, in a direction transverse to the longitudinal axis of the cigarette.

5 Claims, 6 Drawing Figures

CIGARETTES

This invention relates to cigarettes and more specifically to the production of cigarettes provided with an external wrapper which has a modified peripheral conformation.

According to the invention a cigarette having an external, heat-deformable, paper wrapper which comprises a proportion of thermoplastic fibres or filaments, possesses a peripheral conformation which has been modified by the application of heat to said wrapper.

In the case of a plain cigarette, the wrapper referred to is that which enwraps the rod of smokable material of the cigarette, that is what is commonly termed the cigarette paper. In the case of a tipped cigarette, the wrapper may be the cigarette paper and/or a tipping serving to secure a filter tip or mouthpiece to the cigarette rod.

The wrapper may be one that has been made by a conventional paper-making technique. Alternatively it may be a paper which has been manufactured by a non-woven textile process. The air permeability of the wrapper will be in accordance with its use as cigarette paper or tipping and with the cigarette-design requirements. If the wrapper is a tipping, it may be specified to be substantially air impermeable.

Preferably the wrapper comprises a significant proportion, not less than 40% by weight say, of the thermoplastic fibres or filaments, although considerably lower proportions may be in order if the degree of modification of the wrapper is comparatively slight and/or some heat-induced discolouration of the wrapper is not unacceptable. On the other hand, wrapper material containing 90% or more of thermoplastic fibres or filaments may be utilised. The wrapper may comprise fibres or filaments of more than one thermoplastic material. Among the thermoplastic materials which may be utilised are cellulose acetate, viscose, polyethylene, polypropylene and nylon.

The conformation of the wrapper may have been so modified as to provide an embossed-effect pattern over a portion or portions of the surface thereof. The modification may, as an alternative for or an addition to a pattern, comprise an alteration to the surface profile of the cigarette. Thus, for example, a groove or grooves may extend along or around the cigarette, or the cross-section of the cigarette, over at least a portion of the length thereof, may be other than completely circular.

Grooves provided at the exterior surface of the filter of a filter-tipped cigarette may extend from one or the other end of the tip for the full length thereof or for a distance less than the full length. Such grooves may be substantially parallel to the axis of the tip or they may extend helically.

The present invention further provides a method of modifying the peripheral conformation of a cigarette, particularly of a cigarette of circular cross section, wherein the cigarette, which has an external, heat-deformable, wrapper comprising a proportion of thermoplatic fibres or filaments, and a heated forming means are relatively moved in contact with each other in a direction transverse to the longitudinal axis of the cigarette. Cigarettes subjected to this method may be double-length filter tipped cigarettes each comprising a double-length filter element disposed between first and second cigarette rods with tipping wrapper serving to enwrap the full length of the filter element and a short length of each of the cigarette rods, thus to interattach the filter element and the cigarette rods. After such double length cigarettes have been subjected to the method, resulting in a modification of the peripheral conformation thereof in the zone enwrapped by the wrapper and/or in the zones of the major proportions of the respective cigarette papers clear of the tipping wrapper, the double-length cigarettes are severed at the centre plane of the filter element to provide two individual cigarettes.

Conveniently, for carrying out the method, the cigarette and the heated forming means are relatively moved in an arcuate path, but a straight path of relative movement is also appropriate.

In the manufacture of filter-tipped cigarettes it is not uncommon for cigarettes to be rejected because the adhesive coated tipping wrapper is not sufficiently well bonded to the filter element or to the cigarette paper of the cigarette rod. By subjecting cigarettes comprising heat deformable tipping wrappers to the method of the invention however, it is possible to deform the wrappers so that the grip thereof on the filter elements and/or cigarette papers is significantly improved.

Cigarette filters are known which comprise a rod-form filter element having a depression or depressions in its peripheral surface. Such depression may provide means for the passage of dilution air. By subjecting to the method of the invention those portions of an overlying heat-deformable tipping wrapper which bound the depression, it may be ensured that the tipping is in firm sealing contact with the surface of the filter element at the margins of the depression.

If a heat-deformable tipping wrapper is employed together with a heat-deformable cigarette paper, it is possible by suitable deformation of that portion of the tipping wrapper overlying the cigarette paper to obtain both mechanical adhesion and a degree of thermal-weld bonding between the two. A similar effect may be obtained between the tipping wrapper and the filter element if the peripheral surface of that element is heat deformable, whether that surface is the surface of a self-bonded plug of filtration material or is provided by a plugwrap comprising thermoplastic fibres or filaments.

In order that the invention may be clearly understood and readily carried into effect, reference will now be made, by way of example, to the accompanying diagrammatic drawing, in which.

Figure 1:
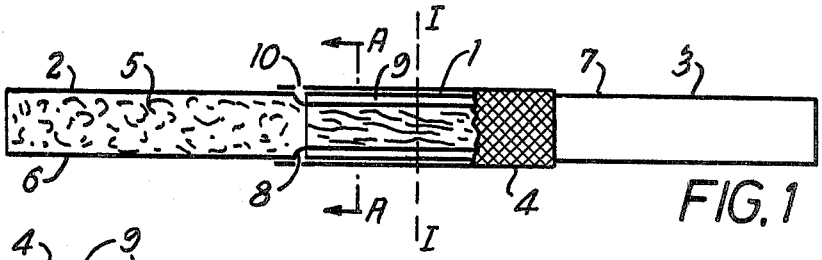
FIG. 1 shows a double length filter-tipped cigarette, partly in axial section.
Figure 2:
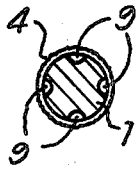
FIG. 2 is a cross sectional view taken at A—A in FIG. 1.

The double cigarette of FIGS. 1 and 2 comprises a double unit length filter plug 1, first and second cigarette rods 2 and 3 and a heat-deformable, paper-tipping wrapper 4 serving to interattach the plug 1 and cigarette rods 2, 3. Each of the rods 2, 3 comprises a filler of smokable material (that of the rod 2 being designated 5) enwrapped in a heat deformable paper wrapper 6, 7 formed of an 80:20 by weight mixture of polyethylene and cellulose fibres.

Prior to their assembly with the filter plug 1, the cigarette rods 2, 3 are provided with annular half grooves at the ends thereof intended to abut the plug 1. Numeral 8 designates the half-groove formed at the end of rod 2. The peripheral conformation of the rods 2, 3 is modified to provide the annular half-grooves at the respective ends thereof by moving the rods 2, 3 in contact with heated forming means of appropriate shape whilst moving the rods in a direction transverse to their axes. United Kingdom Patent Specification No. 1,507,765 describes an apparatus suitable for shaping rods of smoke-filtering material. The apparatus comprises a drum-shaped inner rotor for supporting and conveying the rods and a heatable arcuate outer stator past which the rods may be carried by the rotor in a direction perpendicular to their axes while being caused to rotate about their axes. A similarly constructed and operated apparatus could be employed for forming the annular half-grooves at the inner ends of the cigarette rods 2, 3. Conveniently a full annular groove is formed at the mid point of a double length cigarette rod, which is then severed centrally of the groove to provide the rods 2, 3.

Prior to its having been assembled with the cigarette rods 2, 3, the filter plug 1, which is of cellulose acetate and self-bonded, is subjected to a forming process resulting in the provision of four equi-angularly spaced grooves 9 extending for the full length of the plug 1. The forming process may conveniently be performed or apparatus similar to that disclosed in Specification No. 1,507,765, but having heatable stator means extending parallel to the axis of the rotor. At the time that the filter plug 1 is subjected to the forming process, it may constitute a portion of a rod the length of whcih is equivalent to a multiple of a double-unit length plug, the rod being subsequently cut into the constituent double-unit length plugs.

The paper tipping wrapper 4 is formed substantially wholly of cellulose-acetate fibres and, after having been applied to the three-element assembly of plug 1 and rods 2, 3, the surface conformation is so modified as to provide an embossed-effect pattern thereover, as is indicated by cross hatching in FIG. 1. Again, a forming process used to impress the pattern into the wrapper 4 is conveniently one similar to that disclosed in U.K. Patent Specification No. 1,507,765. Although for the sake of clarity the wrapper 4 is shown in FIGS. 1 and 2 to be spaced from the plug 1 and the cigarette wrappers 6 and 7, it will be understood that in practice the wrapper 4 is in close contact with these components. As a result of the pattern-forming process, a multiplicity of small areas of the wrapper 4 are forced into the underlying surface of the filter plug 1 and into the cigarette wrappers 6 and 7, thus providing a heat-set mechanical bond firmly adhering the wrapper 4 to the plug 1 and rods 2 and 3. Since the latter components are all composed of heat-deformable materials, it will be appreciated that when the tipping wrapper 4 is heated during the pattern-forming process there may occur a degree of thermal-weld bonding between these components and the wrapper 4.

After completion of the pattern-forming process the tipping wrapper 4 is provided with two encircling rows of ventilation holes, one of which rows is designated by numeral 10, in register respectively with the annular half-groove 8 of the rod 2 and the corresponding groove at the inner end of the rod 3. The ventilation holes may be formed mechanically or by laser beam. The double length cigarette is then severed at the plane I—I (FIG. 1) to provide two completed individual cigarettes. When these cigarettes are smoked, ventilation air is drawn in through the ventilation holes into the annular groove and then passes along the plug grooves to the smoker's mouth, whereas the smoke from the cigarette rod passes through the interior of the filter plug.

As an alternative to a self-bonded filter plug, a filter plug comprising a heat deformable plugwrap could be used in the double length cigarette of FIG. 1. Wrapped smoke-filter rods suitable for forming plugs similar to the plug 1 of FIG. 1 are disclosed in United Kingdom Patent Specifications Nos. 2,056,841A and 2,058,543A.

When a cigarette rod comprises a heat deformable wrapper, the end of the rod intended to be lit may be given an inturned profile by moving the rod relatively to a suitably shaped heated former. Such as inturned end profile is possessed by the rod 2 of FIG. 1. As well as being aesthetically pleasing, inturning of the wrapper helps to prevent loss of any loosely packed strands of filler. In the case of a plain cigarette, both ends thereof could be provided with an inturned profile.

Figure 3:
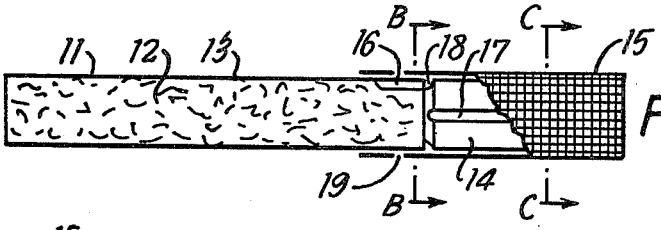
FIG. 3 shows a differently formed, single filtertipped cigarette, with the cigarette rod thereof in axial section and the filter portion with the tipping wrapper partly removed.
Figure 4:
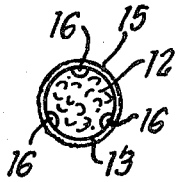
FIGS. 4 and 5 are cross-sectional views taken at B—B and C—C respectively in FIG. 3.
Figure 5:
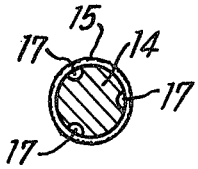

The cigarette diagrammatically depicted in FIGS. 3–5 comprises a cigarette rod 11, constituted by a filler 12 of smokable material enwrapped in a heat deformable paper wrapper 13 formed substantially wholly of polyethylene, and a filter plug 14, of self-bonded cellulose acetate fibres, secured to the rod 11 by means of a heat-deformable, paper tipping wrapper 15 made substantially wholly of polypropylene fibres. Before the rod 11 is assembled with the plug 14, three equi-angularly spaced grooves 16 are formed in the wrapper 13 by rolling the rod 11 in contact with a suitably shaped heated former means. As may be seen from FIG. 3, the grooves 16 extend longitudinally of the cigarette rod 11 from the end of the rod abutting the filter plug 14.

The filter plug 14 is provided, before assembly with the rod 11, with three equi-angularly spaced peripheral grooves 17 which extend from the mouth end of the plug to an annular half-groove 18 formed at the opposite end of the plug.

After the paper tipping wrapper 15 has been applied to the juxtaposed filter plug 14 and cigarette rod 11, there is impressed into the wrapper 15 an all-over embossed effect pattern by a process the same as that employed in relation to the tipping wrapper 4 of the double length cigarette of FIG. 1. This results in a firm bonding of the wrapper 15 to the peripheral surface of the filter plug 14 and to the cigarette paper 13. Subsequently the tipping 15 is provided with a row of ventilation holes 19 overlying the grooves 16 formed in the cigarette rod 11, the arrangement being such that at least one hole 19 communicates with each of the grooves 16. When a cigarette as depicted in FIG. 3 is smoked, ventilation air flows into the grooves 16 through the holes 19. The ventilation air flows from the grooves 16, via the annular groove 18 of the plug 14, to the groove 17 thereof and therein to the smoker's mouth.

Figure 6:
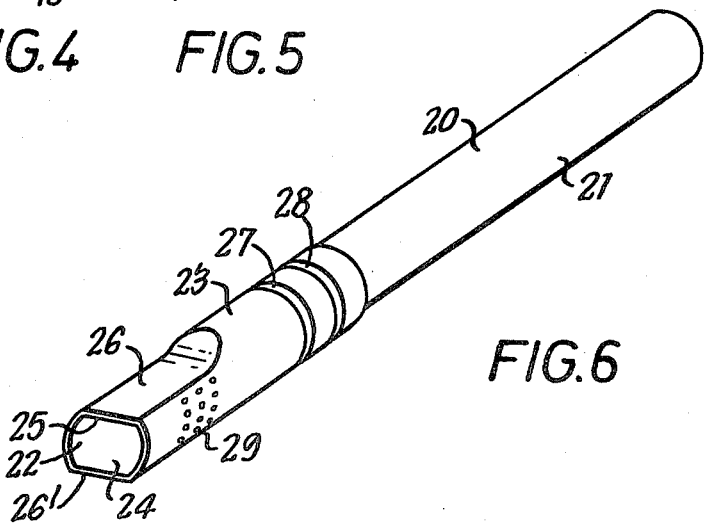
FIG. 6 is a perspective view of a single tipped cigarette of yet a further form.

The cigarette of FIG. 6 comprises a cigarette rod 20, the wrapper 21 of which is of conventional cigarette paper, and a filter plug 22 attached to the rod 20 by a heat deformable paper tipping wrapper 23. The filter plug 22 is composed of fibrous cellulose-acetate or polypropylene filtration material 24 wrapped in a highly porous cellulose-acetate paper plugwrap 25.

After the wrapper 23 has been applied to the plug 22 and the cigarette rod 20, to interattach the components 22 and 23, the cigarette is subjected to a heat-forming process in which the cigarette and a heated forming means are moved relatively of each other in a direction perpendicular to the axis of the cigarette. The heated forming means causes opposed flats 26, 26' (FIG. 6) to be formed on the cigarette at the filter tip end thereof. The flats extending from the mouth end of the tip give a "mouthpiece" conformation.

If, for the purpose of forming the flats 26, 26', apparatus similar to that of U.K. Specification No. 1,507,765 is used, it will be appreciated that while the cigarette is in contact with the heated forming means it would not at the same time be caused to spin about its axis. Conveniently the apparatus has two forming units. One of the flats 26, 26' is formed in the first unit and the cigarette is then fed to the second unit in such manner that the portion of the tip diametrically opposed to the flat formed in the first unit is presented to the heated forming means of the second unit. Alternatively, the apparatus has an inner heatable arcuate stator as well as an outer such stator.

Apparatus similar to that of Specification No. 1,507,765 can be used to provide a further feature of the cigarette of FIG. 6, namely a pair of annular grooves 27, 28 impressed into the wrapper 23 one to either side of the juncture of the plug 22 and the rod 20. As well as providing the cigarette with a decorative embellishment, the grooves 27, 28 ensure a firm anchorage of the tipping wrapper 23 on the plug 22 and rod 20. During the formation of the grooves 27, 28, the cigarette is drivably spun about its axis.

At each of the curved portions of the wrapper 23 extending between the flats 26, 26' the wrapper 23 is provided with a zone 29 of ventilation perforations.

The single cigarettes of FIGS. 3 and 6 may conveniently be initially manufactured as part of double cigarette assemblies.

What is claimed is:

1. A method for modifying the peripheral conformation of a cigarette, wherein the cigarette, which has an external, heat-deformable, wrapper comprising a proportion of thermoplastic fibres or filaments, and a heated forming means are relatively moved in contact with each other in a direction transverse to the longitudinal axis of the cigarette said cigarette relatively moved in contact with the heated forming means being a double-length filter-tipped cigarette with a tipping wrapper enwrapping the full length of the filter element and a short length of each of the cigarette rods thereby interattaching the same.

2. A method according to claim 1, wherein the end of the wrapped cigarette is inturned.

3. A method for modifying the peripheral conformation of a cigarette, wherein the cigarette, which has an external, heat-deformable, wrapper comprising a proportion of not less than 40% by weight of thermoplastic fibres or filaments, and a heated forming means are relatively moved in contact with each other in a direction transverse to the longitudinal axis of the cigarette to produce at least one groove in said cigarette.

4. A method according to claim 3, wherein the cigarette relatively moved in contact with the heated forming means is a double-length filter-tipped cigarette with a tipping wrapper enwrapping the full length of the filter element and a short length of each of the cigarette rods and thereby interattaching the same.

5. A method according to claim 3, wherein the end of the wrapped cigarette is inturned.

* * * * *